US005657940A

United States Patent [19]

Ishikawa et al.

[11] Patent Number: 5,657,940

[45] Date of Patent: Aug. 19, 1997

[54] RELAY DEVICE FOR ROTATING MEMBERS

[75] Inventors: Satoshi Ishikawa; Nobuhiko Suzuki, both of Shizuoka-ken, Japan

[73] Assignee: Yazaki Corporation, Tokyo, Japan

[21] Appl. No.: 582,444

[22] Filed: Jan. 3, 1996

[30] Foreign Application Priority Data

Jan. 12, 1995 [JP] Japan ..... 7-003415

[51] Int. Cl.[6] ..... B65H 75/38; H01R 3/00; H01R 39/00

[52] U.S. Cl. ..... 242/388; 439/164; 439/15

[58] Field of Search ..... 242/388; 439/164, 439/15

[56] References Cited

U.S. PATENT DOCUMENTS 4,824,396 4/1989 Sasaki et al. ..... 439/164 X 4,936,782 6/1990 Bannai et al. ..... 439/164 X

FOREIGN PATENT DOCUMENTS 1-161589 11/1989 Japan .

*Primary Examiner*—John Q. Nguyen

*Attorney, Agent, or Firm*—Finnegan, Henderson, Farabow, Garrett & Dunner, L.L.P.

[57] ABSTRACT

A relay device includes a first rotor having an inner cylinder, a second rotor having an outer cylinder and a single cutter unit for cutting the flexible flat cable. In either case that, due to relative rotation of said first and second rotors, the flexible flat cable is wound around to the side of the inner cylinder over a predetermined volume or that the flexible flat cable is wound back to the side of the outer cylinder over another predetermined volume, the cutter unit serves to cut off the flexible flat cable. The cutter unit includes a C-shaped cutting arm having opposing base ends rotatably supported by the inner cylinder, a cutter holder attached to a leading end of the cutting arm and a cutter body mounted on the cutter holder so as to face the flexible flat cable at the leading end.

6 Claims, 9 Drawing Sheets

RELAY DEVICE FOR ROTATING MEMBERS

BACKGROUND OF THE INVENTION

1. Technical Field

The present invention relates to a relay device for accomplishing an electrical connection between relatively rotating members through the intermediary of a flexible flat cable. More particularly, it relates to a relay device equipped with a cutter which is arranged between a rotating member and an immovable member in a handle or the like and which cuts a flat cable as soon as the handle does not operate to rotate.

2. Description of the Related Art

This kind of relay device is disclosed in Japanese Unexamined Utility Model publication (kokai) No. 1-161589. In the publication, the relay device includes a first rotor having an inner cylinder, a second rotor having an outer cylinder surrounding the inner cylinder of the first rotor through an annular space, a flexible flat cable accommodated in the annular space defined between the inner cylinder and the outer cylinder in a spirally wound manner, and a cutter unit for cutting the flexible flat cable. Note, the flexible flat cable will be also referred as "the cable", hereinafter. The cutter unit is so constructed as to cut off the cable in either case that the cable is wound to the side of the inner cylinder over a first predetermined volume (permissible length) by relative rotations of the first and second rotors or that the cable is wound back to the side of the outer cylinder over a second predetermined volume.

In the above-mentioned relay device, however, there have been employed two kinds of cutter units: one is provided for cutting the cable in case that the cable is wound about the inner cylinder over the first predetermined volume; the other is provided for cutting the cable in case that the cable is wound back about the outer cylinder over the second predetermined volume. That is, the conventional relay device has been provided with two different cutter units in order to cut off the single cable. Consequently, the provision of the two cutter units in the relay device causes its manufacturing cost to be increased undesirably.

SUMMARY OF THE INVENTION

It is therefore an object of the present invention to provide a relay device which is capable of cutting the cable by a single cutter in either case that the cable is wound about the inner cylinder over a predetermined volume or that the cable is wound back about the outer cylinder more than another designated volume thereby to decrease the cost.

The object of the present invention described above can be accomplished by a relay device comprising:

a first rotor having an inner cylinder;

a second rotor arranged so as to rotate with respect to the first rotor relatively, the second rotor having an outer cylinder surrounding the inner cylinder through a predetermined distance, either one of the first and second rotors being arranged immovably while the other of the first and second rotors is arranged movably so as to rotate within a predetermined rotational span;

a flexible flat cable accommodated in an annular space defined between the inner cylinder and the outer cylinder, the flexible flat cable being spirally wound and having an end portion carried by the inner cylinder and the other end portion carried by the outer cylinder; and cutting means for cutting off the flexible flat cable in either case that, due to relative rotation of the first and second rotors, the flexible flat cable is wound around on the side of the inner cylinder over a predetermined volume or that the flexible flat cable is wound back on the side of the outer cylinder over another predetermined volume;

wherein the cutting means comprises a cutting arm having a base end thereof rotatably supported by the inner cylinder and a leading end arranged so as to be close and apart from the inner cylinder, a cutter holder attached to the leading end of the cutting arm and a cutter body mounted on the cutter holder so as to face the flexible flat cable at the leading end.

In the so-constructed relay device, since either one of the first and second rotors is arranged on the side of an immovable member while the other is arranged on the side of a rotating member, the first rotor and the second rotor rotate relatively.

The flexible flat cable is not cut off by the cutting means so long as the flexible flat cable is wound around to the side of the inner cylinder with a sufficient room or the flexible flat cable is wound back to the side of the outer cylinder with a sufficient room.

On the contrary, if a neutral point in a rotational range of a handle (steering wheel) is shifted to one direction, the flexible flat cable would be wound around the inner cylinder tightly in its stretched condition. Such a condition corresponds to a first case that the flexible flat cable is wound around the inner cylinder over a predetermined volume (permissible length). In this case, the cutter holder is urged inwardly by the flexible flat cable positioned at the exterior of the cutter holder, so that the cutter body operates to cut off the flexible flat cable, digging thereinto.

On the other hand, if the neutral point in the rotational range of the handle is shifted to another direction, the flexible flat cable would be further wound back even after it has been wound back so as to be in contact with the outer cylinder tightly. Such a condition correspond to a second case that the cable is wound back to the outer cylinder over another predetermined volume. In this case, the cutting arm pivots about the base ends, so that the leading end of the arm is brought into contact with the flexible flat cable in tight contact with the outer cylinder. Then, owing to this abutting force of the leading end on the flexible flat cable, the cutter holder is shifted to the side of the flexible flat cable at the leading end of the cutting arm, so that the cutter body operates to cut off the cable, digging thereinto.

As mentioned above, in either case that the flexible flat cable is wound around to the side of the inner cylinder over a predetermined volume or wound back to the side of the outer cylinder over another predetermined volume, the only cutter body allows the cable to be cut off. This means that it is possible to decrease numbers of the cutter bodies in comparison with the conventional relay device thereby to decrease the manufacturing cost of the device.

It is noted that this condition where the flexible flat cable is now cut off, which originates in such as mistakes in assembling the relay device, can be instantly and easily found by a sequent conduction test for the cable. Thus, there is not caused such a case that the cable is cut off during an user's using the relay device at all.

According to the present invention, there is also provided a relay device comprising:

a first rotor having an inner cylinder;

a second rotor arranged so as to rotate with respect to the first rotor relatively, the second rotor having an outer cylinder surrounding the inner cylinder through a predetermined distance, either one of the first and second rotors being arranged immovably while the other of the first and second rotors is arranged movably so as to rotate within a predetermined rotational span;

a flexible flat cable accommodated in an annular space defined between the inner cylinder and the outer cylinder, the flexible flat cable being spirally wound and having an end portion carried by the inner cylinder and the other end portion carried by the outer cylinder; and cutting means for cutting off the flexible flat cable in either case that, due to relative rotation of the first and second rotors, the flexible flat cable is wound around on the side of the inner cylinder over a predetermined volume or that the flexible flat cable is wound back on the side of the outer cylinder over another predetermined volume;

wherein the cutting means includes a cutting member arranged between the flexible flat cable and the inner cylinder and a cutter body formed on one end of the cutting member so as to face the flexible flat cable.

In the present invention, when the flexible flat cable is wound around to the side of the inner cylinder over a predetermined volume, the relay device operates as similar to the former relay device, so that the flexible flat cable is cut off by the cutter body arranged at the base end of the cutting member.

However, in case that the flexible flat cable is wound back to the outer cylinder over another predetermined volume, the cable and the cutting member would encroach on the inner cylinder in one rotational direction opposite to the wind-back direction. Then, since the cutting member and the cable are pressed to each other, the cutter body operates to cut off the cable, digging thereinto.

These and other objects and features of the present invention will become more fully apparent from the following description and appended claims taken in conjunction with the accompany drawing.

DESCRIPTION OF THE PREFERRED EMBODIMENT

A variety of embodiments of the present invention will be described with reference to FIGS. 1 to 16. First of all, we now describe a first embodiment of the present invention with reference to FIGS. 1 to 8.

Figure 8:
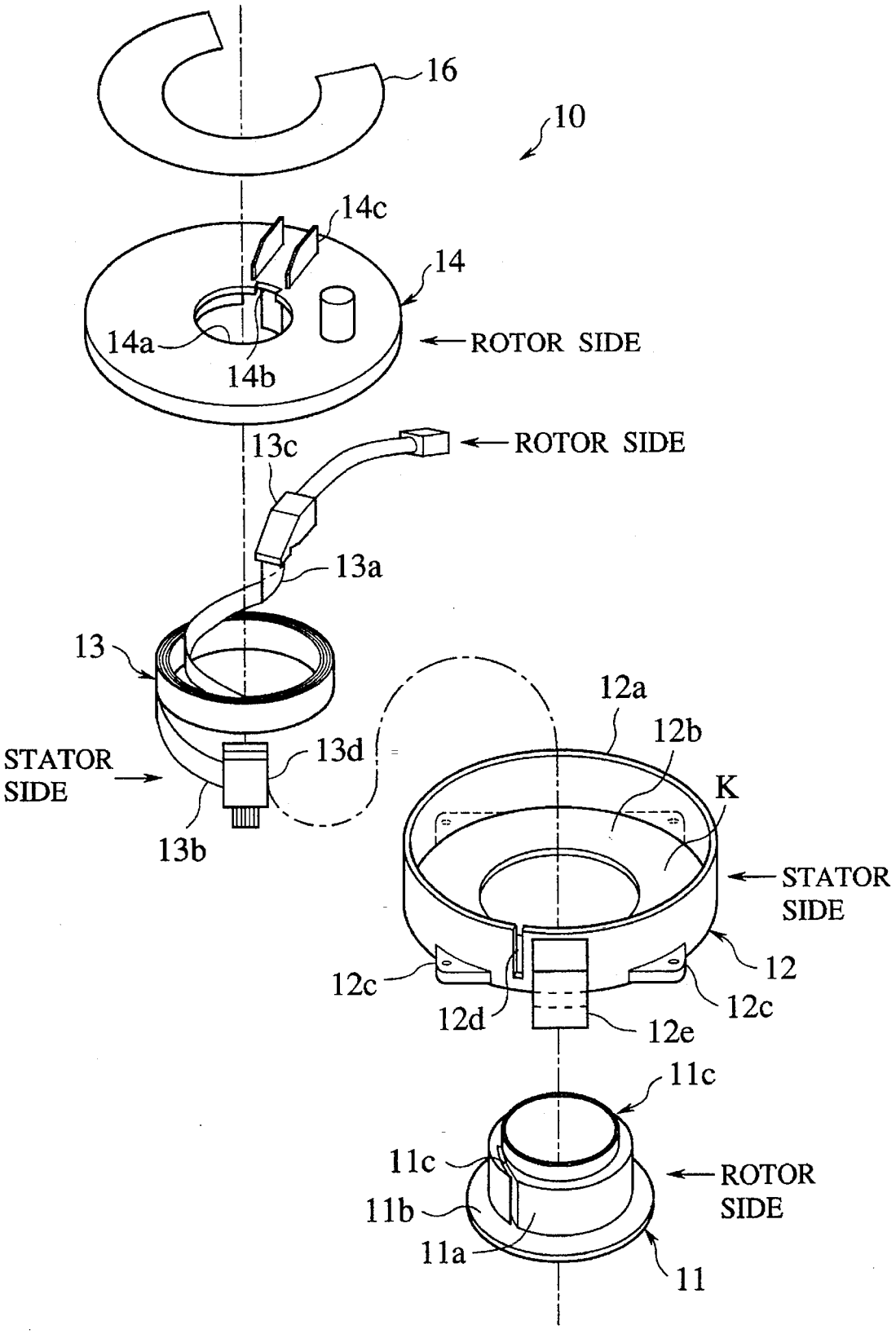
FIG. 8 is a perspective view of the disassembled relay device including the cutter unit of FIG. 1.

As shown in FIG. 8, a relay device 10 includes a rotor (a first rotor) 11 having an inner cylinder 11*a* and a flange 11*b* extending from a lower end of the inner cylinder 11*a* radially outwardly and a stator (a second rotor) 12 having an outer cylinder 12*a* surrounding the inner cylinder 11*a* through a predetermined distance and an annular bottom plate 12*b* extending from a lower end of the outer cylinder 12*a* inwardly along an upper face of the flange 11*b*.

The relay device 10 further includes a flexible flat cable 13 and an upper cover 14. The flexible flat cable 13 is accommodated in an annular space K defined between the inner cylinder 11*a* and the outer cylinder 12*a* in a spirally wound manner, having an inner end (portion) 13*a* supported by a holding part 11*c* of the inner cylinder 11*a* and an outer end (portion) 13*b* supported by the outer cylinder 12*a*. The upper cover 14 is attached to an upper end of the inner cylinder 11*a* for drawing out the inner end 13*a* of the flexible flat cable 13.

Figure 1:
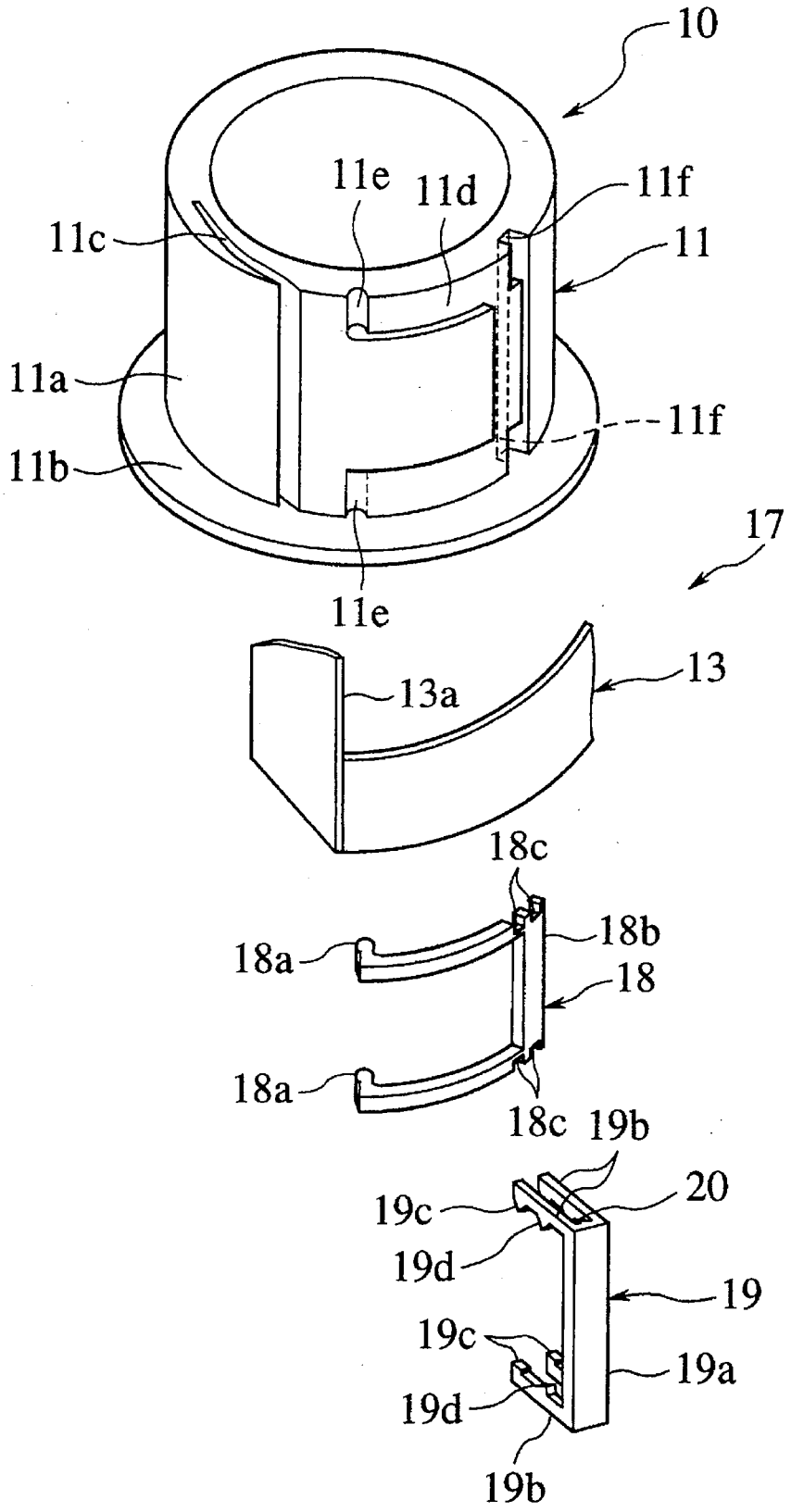
FIG. 1 is a perspective view of a disassembled cutter unit and an inner cylinder of a relay device between rotating members, in accordance with a first embodiment of the present invention.
Figure 2:
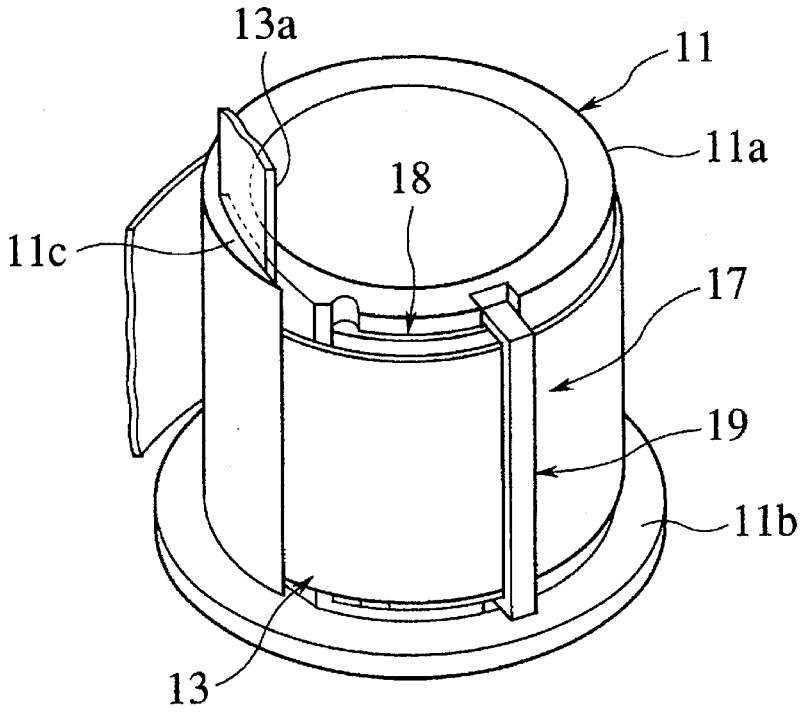
FIG. 2 is a perspective view of the assembled cutter unit of the relay device of FIG. 1.
Figure 3:
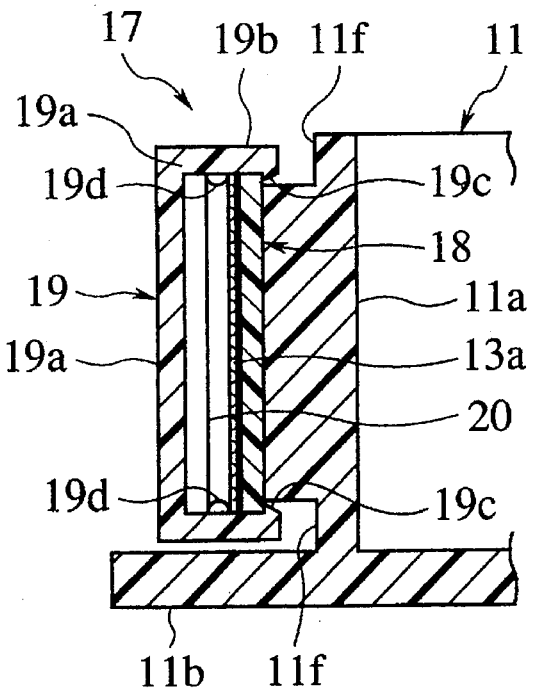
FIG. 3 is a cross sectional view showing an essential part of the cutter unit of the relay device of FIG. 1.

As shown in FIGS. 1 and 2, the relay device 10 further includes a cutter unit (cutting means) 17 for cutting the flexible flat cable 13 in either case that, due to relative rotations of the rotor 11 and the stator 12, the flexible flat cable 13 is wound about the inner cylinder 11*a* over a predetermined volume or that the flexible flat cable 13 is wound back about the outer cylinder 12*a* more than another designated volume.

We now describe the above-mentioned arrangement in detail.

As shown in FIG. 1, being provided with the inner cylinder 11*a* and the flange 11*a*, the first rotor 11 is associated with a rotating member such as a steering wheel constituting a handle section of an automobile. The inner cylinder 11*a* is provided on an outer periphery thereof with a holding part 11*c* for holding the inner end portion 13*a* of the flexible flat cable 13. Further, the inner cylinder 11*a* is provided on an outer peripheral surface thereof with a holding recess 11*d* for carrying the cutter unit 17.

As shown in FIG. 8, the stator 12 is connected to a not-shown immovable member, such as a steering column of the handle section of the automobile, through the intermediary of blankets 12*c*. The outer cylinder 12*a* has a slit 12*d* formed to hold the outer end portion 13*b* of the flexible flat cable 13 and to draw out it for the immovable member. Further, the outer cylinder 12*a* is provided with a holder 12*e* for holding a connector 13*d* on the stator side, which will be described later.

The flexible flat cable 13 has the inner end portion 13*a* bent upwardly at right angles. In arrangement, this bent part ( i.e., the inner end portion 13*a*) of the flexible flat cable 13 is retained in the holding part 11*c*. Further, a terminal of the inner end portion 13*a* of the flexible flat cable 13 is to be electrically connected to a connector 13*c* on the rotor side. On the other hand, the outer end 13*d* is drawn out through the slit 12*d* formed in the stator 12, so that a terminal of the outer end 13*d* is connected to a connector 13*d* on the stator side. The connector 13*d* is carried by a holder 12*e* mounted on the stator 12.

As shown in FIG. 8, the upper cover 14 is provided with a through hole 14*a* which is coaxial with the inner cylinder 11*a*. The upper cover 14 is fixed to an upper end of the inner cylinder 11*a* through not-shown screws. The through hole 14*a* has a notch 14*b* formed in a position corresponding to the holding part 11*c* of the inner cylinder 11*a* to draw out the inner end portion 13*a* of the flexible flat cable 13. Further, the upper cover 14 is provided on an upper surface thereof with a holder 14*c* (the rotor side) for holding the connector 13*c* connected to the inner end portion 13*a* of the flexible flat cable 13 and provided on the upper surface with a label 16 on which matters to be attend or the like are written.

The cutter unit 17 includes a substantial C-shaped cutting arm 18 having base ends 18*a* rotatably supported by the inner cylinder 11*a* so that a leading end 18*b* is movable close and apart from the cylinder 11*a*, a cutter holder 19 attached to the leading end 18*b* of the cutting arm 18 and a cutter body 20 mounted on the cutter holder 19 so as to face a part of the flexible flat cable 13 at the leading end 18.

In detail, the upper and lower base ends 18*a* are pivotably supported in pivot recesses 11*e* formed on the inner cylinder 11*a*, so that the leading end 18*b* of the cutting arm 18 can get close to the inner cylinder 11*a* and get apart therefrom. Further, the cutting arm 18 is provided at the leading end 18*b* with guide grooves 18*c* for guiding movements of the cutter holder 19.

The cutter holder 19 has a cutter carrying part 19*a* and four leg parts 19*c* projecting from respective ends of the cutter carrying part 19*a*. Each of the leg part 19 is provided at a leading end thereof with an engagement part 19*c* which abuts on a back surface of the cutting arm 18 under condition that the part 19*c* is fitted in each guide groove 18*c* of the cutting arm 18.

Further, each of the leg parts 19*b* is provided with a stop 19*d* which normally abuts on a lateral edge of the flexible flat cable 13 at the leading end 18*b* of the cutting arm 18 thereby to prevent the cutter body 20 from abutting on the flexible flat cable 13. However, the stop 19*d* is so formed as to surmount the lateral edge of the flexible flat cable 13 when the cutter holder 10 is urged to the flexible flat cable 13. Further, the inner cylinder 11*a* is provided with a recess part 11*f* in and out which the leg parts 19*b* can go.

The cutter body 20 is arranged so as to oppose a part of the flexible flat cable 13 at the leading end 18*b* of the cutting arm 18.

In order to assemble the relay device 10, upon mounting the lowermost first rotor 11 on a working table for assembling the device 10 at first, the second rotor 12 is then put on the first rotor 11. Thus, the annular bottom plate 12*b* of the second rotor 12 is mounted on the flange 11*b* of the first rotor 11 thereby to define an annular space K between the inner cylinder 11*a* and the outer cylinder 12*a*. Then, the spirally wound flexible flat cable 13 is accommodated in the annular space K.

Then, the inner end portion 13*a* of the flexible flat cable 13 is inserted into the holding part 11*c* of the inner cylinder 11*a*. Thereafter, the cutter holder 19 is mounted on the leading end 18*b* of the cutting arm 18. Consequently, the flexible flat cable 13 is held between the leading end 18*b* of the cutting arm 18 and the cutter holder 19. Note, due to a provision of the stops 19*d*, the cutter body.20 is positioned apart from the flexible flat cable 13.

Then, the outer end portion 13*b* of the flexible flat cable 13 is drawn out of the slit 12*d* of the outer cylinder 12*a* while the flexible flat cable 13 is held by the slit 12*d* and the connector 13*d* on the stator side is attached to the holder 12*e* on the stator side.

Next, while mounting the upper cover 14 on the upper end of the inner cylinder 11*a*, the inner end portion 13*a* of the flexible flat cable 13 and the connector 13*c* on the rotor side are drawn through the through hole 14*a* upwardly. Further, by fixing the upper cover 14 on the upper end of the inner cylinder 11*a* by screws, the connector 13 on the rotor side is attached on the holder 14*c*. In this state, the inner end portion 13*a* of the flexible flat cover 13 is drawn upwardly through the upper cover 14 while the upper end of the outer cylinder 12*a* is covered with the upper cover 14. Finally, the label 16 is pasted on the upper surface of the upper cover 14, whereby the assembling of the relay device 10 can be completed.

We now describe an operation of the above-constructed relay device 10 installed in the handle section of the automobile.

First, when the handle is turned, the rotor 11 is also rotated with respect to the stator 12. Then, if turning the handle in a direction of winding the flexible flat cable 13 round the inner cylinder 11*a*, the flexible flat cable 13 would be wound so as to encircle the exterior of the inner cylinder 11*a* and the cutter unit 17. At this time, if a turning of the handle is quitted under condition that there is sufficient room between portions of the flexible flat cable 13 overlapping to each other, between the cutter unit 17 and the flexible flat cable 13 or between the inner cylinder 11*a* and the flexible flat cable 13, excessive force would not be applied on the flexible flat cable 13, so that the cutter unit 17 does not cut off the flexible flat cable 13.

Again, in even a case that the flat cable 13 is wound back to the outer cylinder 12*a* by turning of the handle and that the turning of the handle is quitted under condition that there is sufficient room between portions of the flexible flat cable 13 overlapping to each other, between the cutter unit 17 and the flexible flat cable 13 or between the inner cylinder 11*a* and the flexible flat cable 13, excessive force would not be applied on the flexible flat cable 13, so that the flexible flat cable 13 would not be cut by the cutter unit 17.

Figure 4:
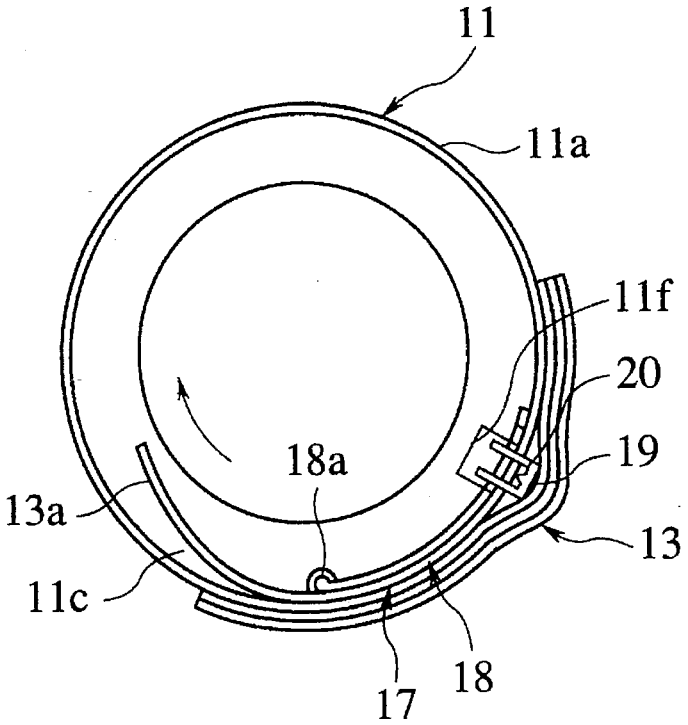
FIG. 4 is a plan view of the cutter unit of the relay device of FIG. 1, explaining a function of the cutter unit of FIG. 1.
Figure 5:
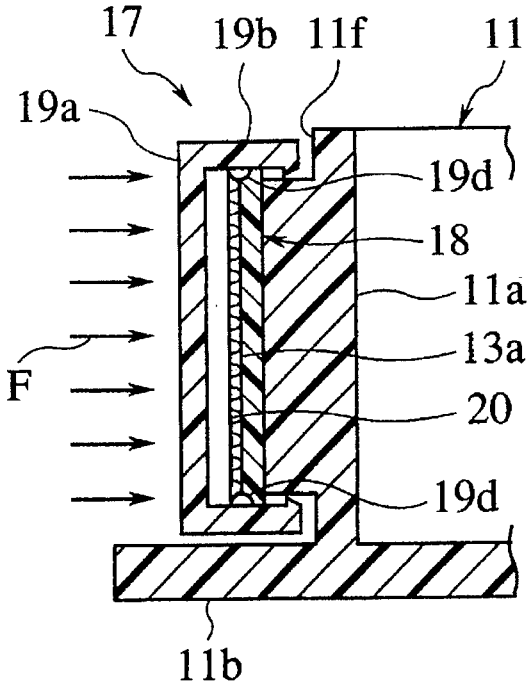
FIG. 5 is a cross sectional view of the cutter unit of the relay device of FIG. 1, explaining the function of FIG. 4.

However, it should be noted that, if a neutral point in a rotational range of the handle is shifted to one direction by mistake in assembling etc., the flexible flat cable 13 would wind around the inner cylinder 11*a* tightly in its stretched condition, as shown in FIG. 4. This is a case that the flexible flat cable 13 is wound around the inner cylinder 11*a* over a predetermined volume. In such a case, the cutter holder 19 is urged inwardly by the flexible flat cable (portion) 13 positioned at the exterior of the cutter holder 19, as shown in FIG. 5. That is, under this condition, a force F (FIG. 5) is applied on the cutter holder 19 in a direction extending from the flexible flat cable 13 toward the inner cylinder 11*a*. Consequently, the stops 19*d* of the cutter holder 19 surmount the lateral edges of the flexible flat cable (portion) 13 on the leading end 18*b* of the cutting arm 18 thereby to cut off the flexible flat cable 13.

Figure 6:
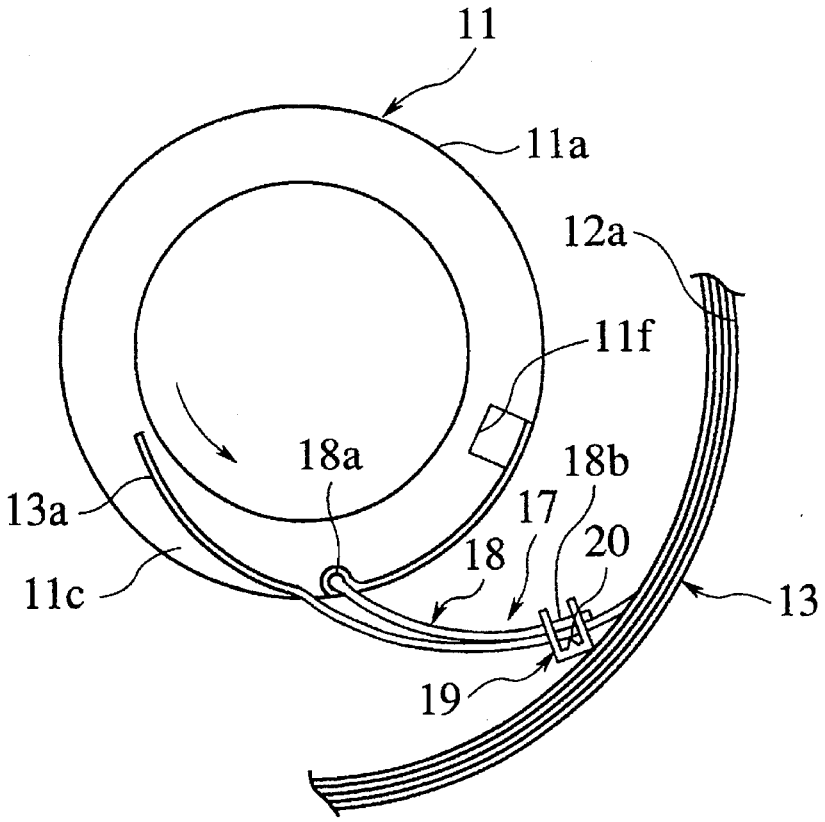
FIG. 6 is a plan view of the cutter of the relay device of FIG. 1, explaining another function of the cutter unit of FIG. 1.
Figure 7:
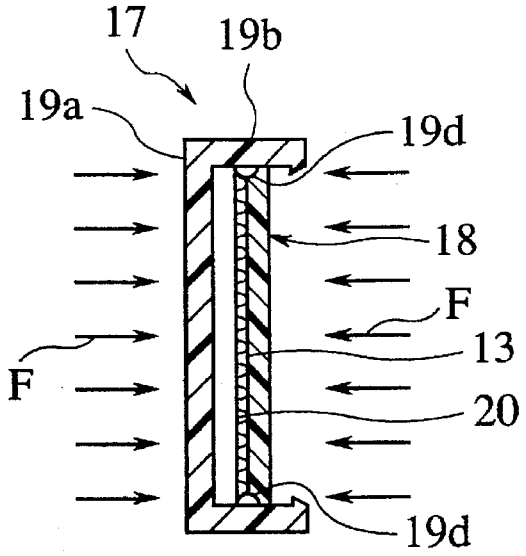
FIG. 7 is a cross sectional view of the cutter unit of the relay device of FIG. 1, explaining the function of FIG. 6.

On the other hand, if the neutral point in the rotational range of the handle is shifted to another direction, there is a case that the handle is still rotatable in the winding-back direction of the flexible flat cable 13 even after it has been wound back so as to be in contact with the outer cylinder 12*a* tightly, as shown in FIG. 6. This is a case that the flexible flat cable 13 is wound back to the outer cylinder 12*a* over another predetermined volume. However, according to the embodiment, the cutting arm 18 will pivot about the base ends 18*a*, so that the leading end 18*b* is brought into contact with the flexible flat cable 13 abutting on the outer cylinder 12*a*. Consequently, the stops 19*d* of the cutter holder 19 surmount the lateral edges of the flexible flat cable (portion) 13 on the leading end 18*b* of the cutting arm 18 thereby to cut off the flexible flat cable 13.

As mentioned above, in the relay device 10 of the embodiment, in either case that the flexible flat cable 13 is wound around to the side of the inner cylinder 11*a* over a predetermined volume or wound back to the side of the outer cylinder 11*b* over another predetermined volume, the only cutter body 20 allows the flexible flat cable 13 to be cut off. This means that it is possible to decrease numbers of the cutter bodies in comparison with the conventional relay device thereby to decrease the manufacturing cost of the device.

Furthermore, according to the embodiment, unless the flexible flat cable 13 is wound around over a predetermined volume or wound back over another predetermined volume, the cutter body 20 does not abut on the flexible flat cable 13 at all. Therefore, it is possible to prevent the flexible flat cable 13 from being damaged by the cutter body 20 in the normal using condition.

Note that, this condition where the flexible flat cable 13 is now cut off, which originates in such as mistakes in assembling the relay device 10, can be instantly found by a sequent conduction test for the flexible flat cable 13. Thus, there is not caused such a case that the flexible flat cable 13 is cut off during an user's using the relay device 10 at all.

Figure 9:
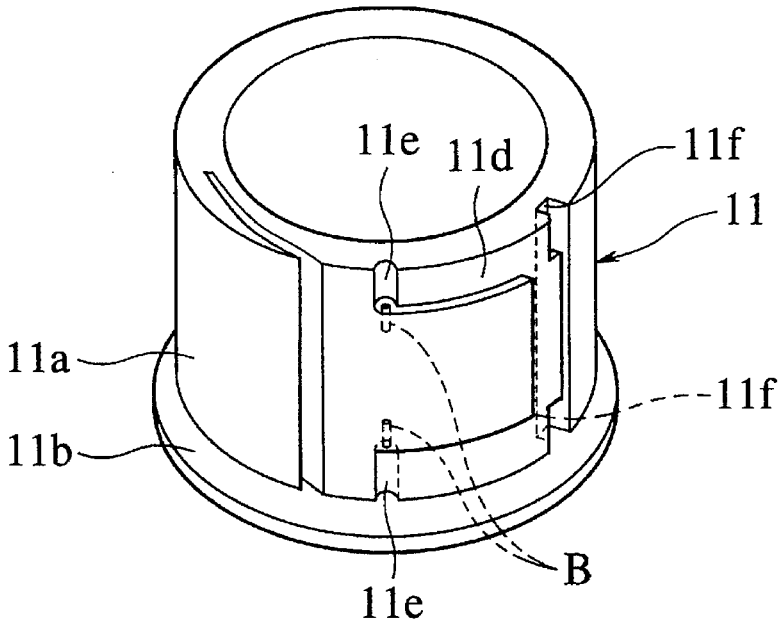
FIG. 9 is a perspective view of an inner cylinder in a modification of the inner cylinder of FIG. 1.
Figure 10:
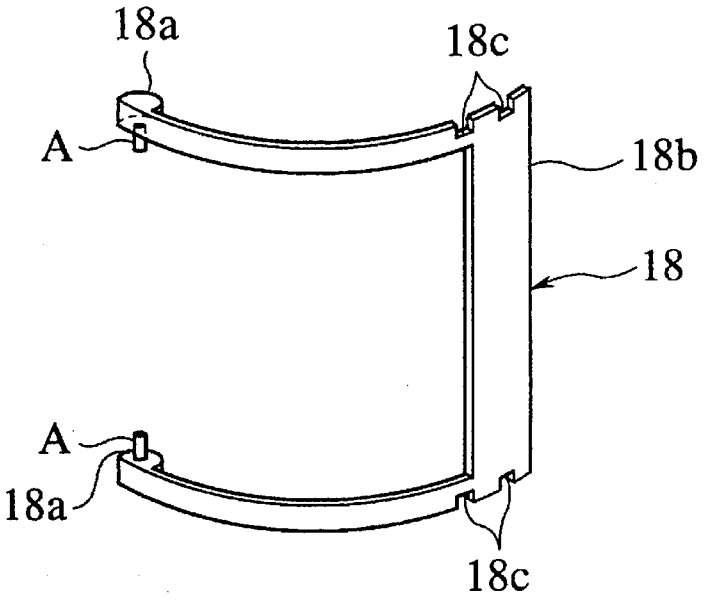
FIG. 10 is a perspective view of a cutting arm in a modification of a cutting arm constituting the cutter unit of FIG. 1.

Although the cutting arm 10 of the above-mentioned embodiment is adapted in such a manner that the base ends 18*a* are engaged in the recesses 11*e* on the inner cylinder 11*a*, engagement pins A may be arranged on the base ends 18*a* of the cutting arm 18 while the recesses lie are provided with holes B for engagement with the pins A in a modification, as shown in FIGS. 9 and 10.

We now describe a second embodiment of the present invention with reference to FIGS. 11 to 16. Note, in this embodiment, elements common to those in the first embodiment are indicated by the same reference numerals, whereby their descriptions are deleted. A difference between the second embodiment and the first embodiment resides in structure of the cutter unit 17.

Figure 11:
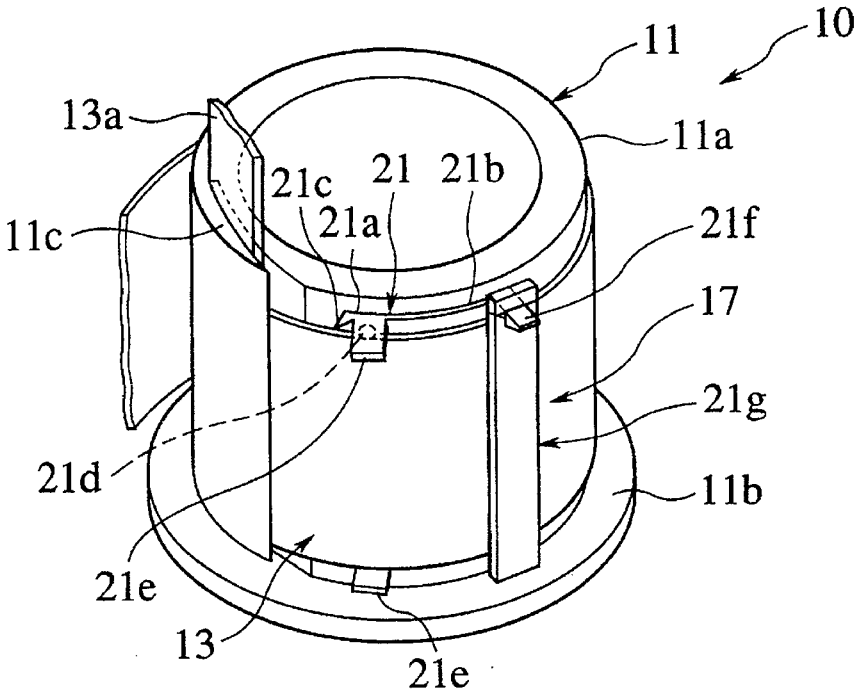
FIG. 11 is a perspective view of a cutter unit of a relay device between rotating members, in accordance with a second embodiment of the present invention.
Figure 12:
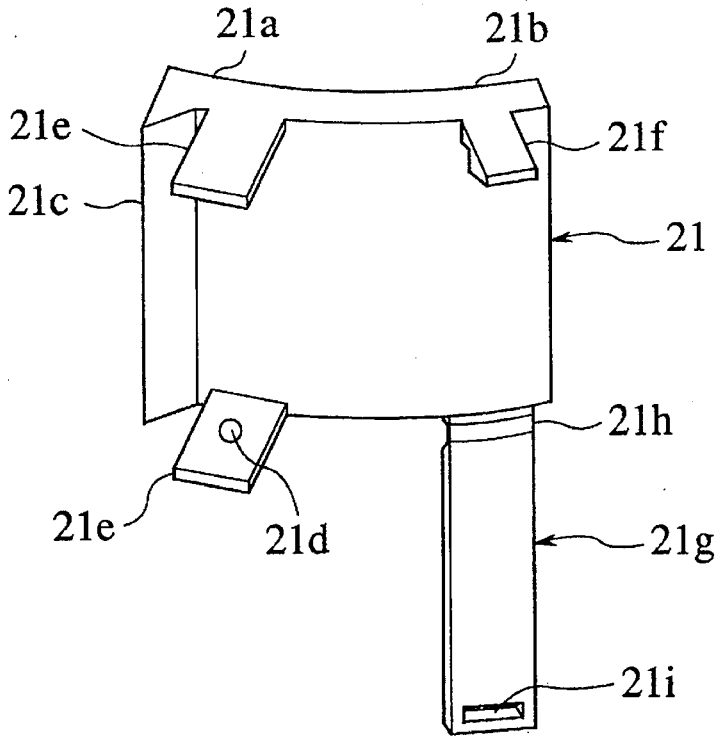
FIG. 12 is a perspective view of a cutting member constituting the cutter unit of FIG. 11.
Figure 13:
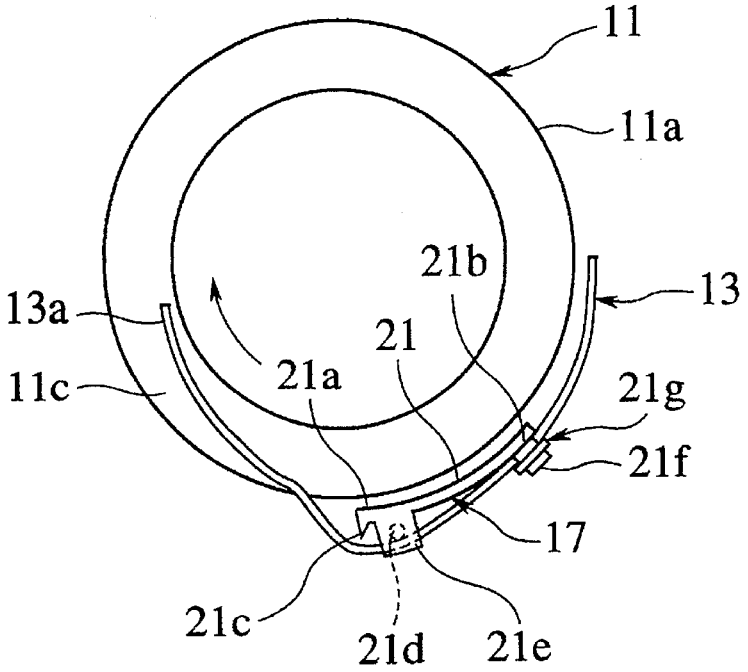
FIG. 13 is a plan view of the cutter unit of the relay device of FIG. 11.

In detail, as shown in FIGS. 11 and 13, the cutter unit 17 includes a cutting member 21 arranged between the flexible flat cable 13 and the inner cylinder 11*a* and a cutter body 21*c* arranged on a base end 21*a* of the cutting member 21 so as to face the flexible flat cable 13.

The cutting member 21 is provided on the base end 21*a* with a pair of guide plates 21*e* for guiding the lateral edges of the flexible flat cable 13. Each of the guide plate 21 has a stop 21 to prevent the cutter body 21*c* from abutting on the flexible flat cable 13. The stops 21, which is shaped to be convex, is adapted so as to surmount the lateral edges of the flexible flat cable 13 when being urged to the cutter body 21*c* by a predetermined force.

In the vicinity of the leading end 21*b* of the cutting member 21, it has an engagement projection 21*f* formed at a lateral edge thereof and a pivot plate 21*g* formed at the other lateral edge. The pivot plate 21*g* is pivotably attached to the lateral edge through a hinge part 21*h*, being provided at a tip thereof with an opening 21*i* for engagement with the projection 21*f*. By the engagement of the opening 21*i* of the pivot plate 21*g* with the projection 21*f*, the flexible flat cable 13 can be interposed between the pivot plate 21*g* and the leading end 21*b*.

We now describe an operation of the above-constructed relay device 10 installed in the handle section of the automobile.

When the above neutral point in the rotational range of the handle is in the normal position, the flexible flat cable 13 is not cut by the cutter unit 17, as similar to the first embodiment.

Figure 14:
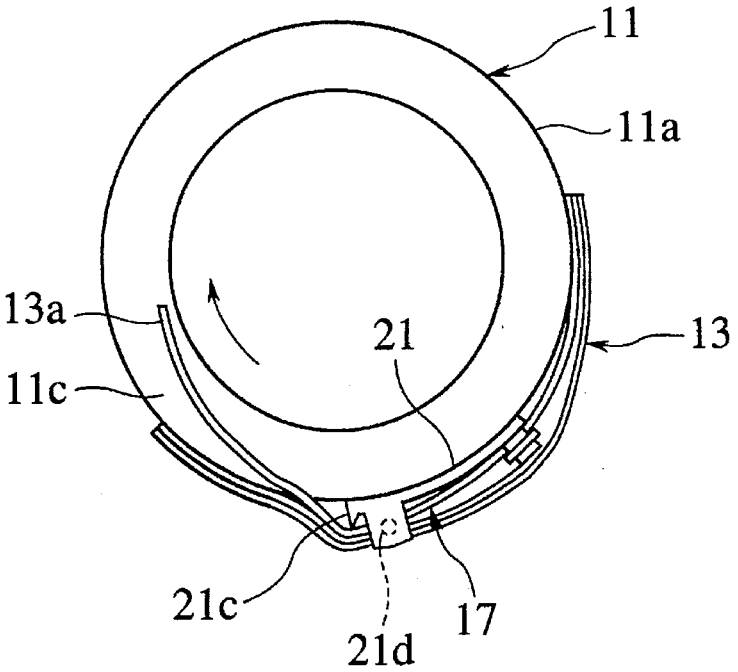
FIG. 14 is a plan view of the cutter unit of the relay device of FIG. 11, explaining a function of the cutter unit.

However, if the neutral point in the rotational range of the handle is shifted to one direction by mistake in assembling etc., the flexible flat cable 13 would wind around the inner cylinder 11*a* tightly in its stretched condition, as shown in FIG. 14. This is also the case that the flexible flat cable 13 is wound around the inner cylinder 11*a* over a predetermined volume. In such a case, the cutting member 21 is forced to the inner cylinder 11*a* by the flexible flat cable (portion) 13 positioned at the exterior of the cutting member 21. Consequently, the stops 21*d* of the cutting member 21 surmount the lateral edges of the flexible flat cable (portion) 13 on the leading end 18*b* of the cutting arm 18, whereby the flexible flat cable 13 can be cut off by the cutter body 21*c* which digs thereinto.

Figure 15:
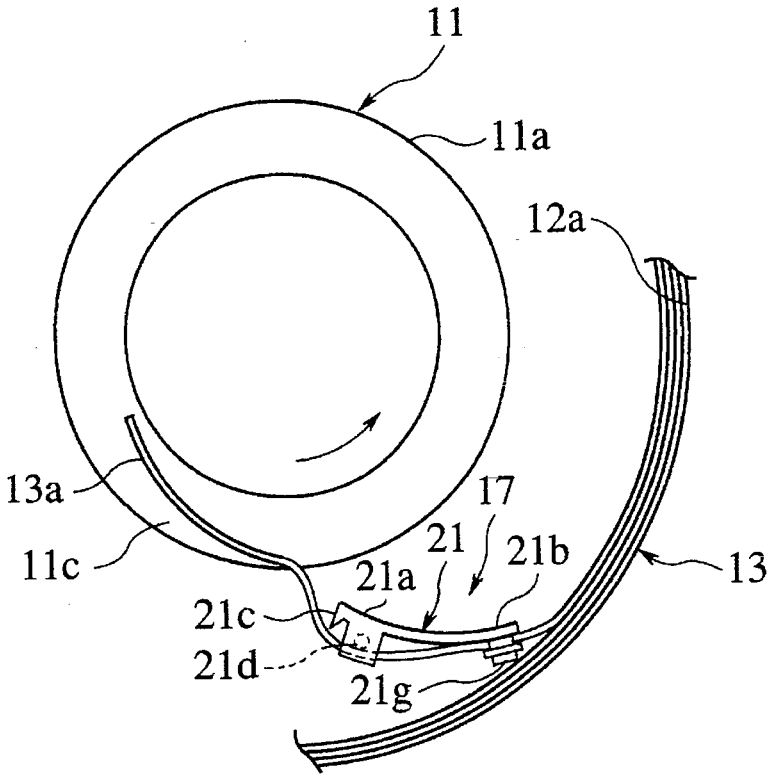
FIG. 15 is a plan view of the cutter unit of the relay device of FIG. 11, explaining the function of the cutter unit.
Figure 16:
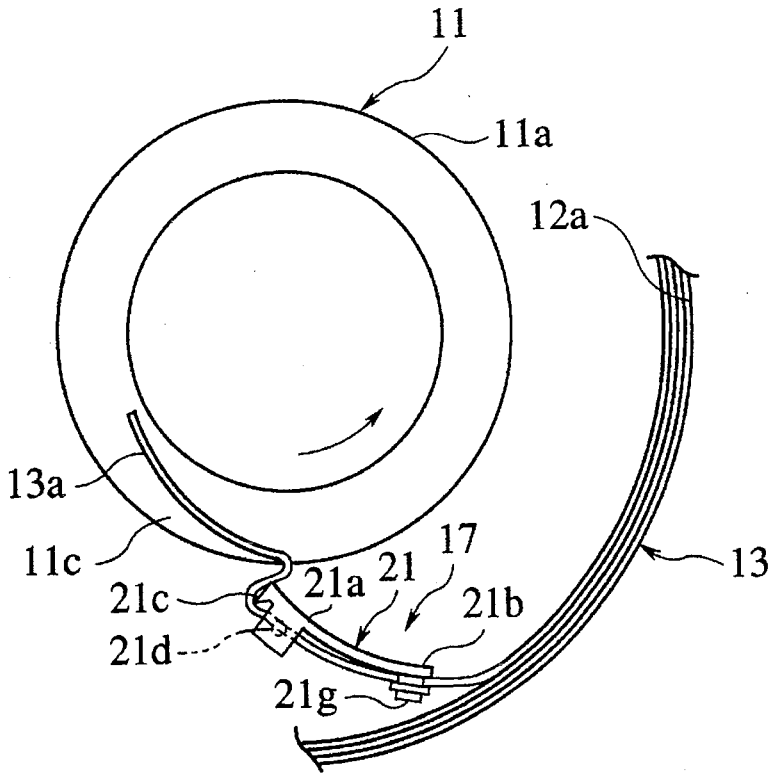
FIG. 16 is a plan view of the cutter unit of the relay device of FIG. 11, explaining the function of the cutter unit.

On the other hand, if the neutral point in the rotational range of the handle is shifted to another direction, there is a case that the handle is still rotatable in the winding-back direction of the flexible flat cable 13 even after it has been wound back so as to be in contact with the outer cylinder 12*a* tightly, as shown in FIG. 15. This corresponds to the case that the flexible flat cable 13 is wound back to the outer cylinder 12*a* over another predetermined volume. In this case, as shown in FIG. 16, the flexible flat cable 13 and the cutting member 21 encroach on the inner cylinder 11*a* in one rotational direction opposite to the wind-back direction. Then, the cutting member 21 and the flexible flat cable 13 are pressed to each other, whereby the stops 21*d* surmount the lateral edges of the flexible flat cable 13. In this way, the flexible flat cable 13 can be cut off by the cutter body 21*c* which digs thereinto.

Other operations and effects of the above-mentioned relay device 10 are similar to those in the first embodiment.

Although the first rotor as the rotor 11 is coupled to the rotating member while the second rotor as the stator 12 is coupled to the fixed member in the above-mentioned embodiments, the first rotor as the stator 12 may be connected to the fixed member while the second rotor as the rotor 11 is connected to the fixed member in the modification.

Finally, it will be understood by those skilled in the art that the foregoing description is one of preferred embodiments of the disclosed relay device, and that various changes and modifications may be made to the present invention without departing from the spirit and scope thereof.

What is claimed is:

1. A relay device comprising:

a first rotor having an inner cylinder;

a second rotor arranged so as to rotate with respect to said first rotor relatively, said second rotor having an outer cylinder surrounding said inner cylinder through a predetermined distance, either one of said first and second rotors being arranged immovably while the other of said first and second rotors is arranged movably so as to rotate within a predetermined rotational span;

a flexible flat cable accommodated in an annular space defined between said inner cylinder and said outer cylinder, said flexible flat cable being spirally wound and having an end portion carried by said inner cylinder and the other end portion carried by said outer cylinder; and cutting means for cutting off said flexible flat cable in either case that, due to relative rotation of said first and second rotors, said flexible flat cable is wound around on the side of said inner cylinder over a predetermined volume or that said flexible flat cable is wound back on the side of said outer cylinder over another predetermined volume;

wherein said cutting means comprises a cutting arm having a base end thereof rotatably supported by said inner cylinder and a leading end arranged so as to be close and apart from said inner cylinder, a cutter holder attached to said leading end of said cutting arm and a cutter body mounted on said cutter holder so as to face said flexible flat cable at said leading end.

2. A relay device as claimed in claim 1, wherein said inner cylinder is provided with a recess in which said base end are pivotably supported.

3. A relay device as claimed in claim 2, wherein said cutting arm is provided at said leading end with guide grooves for guiding movements of said cutter holder.

4. A relay device as claimed in claim 3, wherein said cutter holder has a cutter carrying part and four leg parts which project from respective ends of said cutter carrying part and wherein each of said leg part is provided at a leading end thereof with an engagement part which abuts on a back surface of said cutting arm under condition that said cutting arm is fitted in each of said guide grooves.

5. A relay device as claimed in claim 4, wherein each of said leg parts is provided with a stop which normally abuts on a lateral edge of said flexible flat cable at said leading end of said cutting arm thereby to prevent said cutter body from abutting on said flexible flat cable and which surmounts said lateral edge of said flexible flat cable when said cutter holder is urged to said flexible flat cable.

6. A relay device as claimed in claim 5, wherein said cutting arm is provided on said base end with an engagement pin while said inner cylinder is provided in said recess with a holes for engagement with said engagement pin.

* * * * *